US007723281B1

(12) United States Patent
Herdt et al.

(10) Patent No.: US 7,723,281 B1
(45) Date of Patent: May 25, 2010

(54) STABLE AQUEOUS ANTIMICROBIAL ENZYME COMPOSITIONS COMPRISING A TERTIARY AMINE ANTIMICROBIAL

(75) Inventors: Brandon L. Herdt, Hastings, MN (US); Werner Strothoff, Sassenberg Füchtorf (DE); Alice Siegmann, Düsseldorf (DE)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 12/356,435

(22) Filed: Jan. 20, 2009

(51) Int. Cl.
*C11D 3/48* (2006.01)
*C11D 3/386* (2006.01)
*C11D 3/30* (2006.01)
*C11D 3/43* (2006.01)

(52) U.S. Cl. ..... 510/214; 510/161; 510/238; 510/253; 510/300; 510/320; 510/382; 510/392; 510/432; 510/480; 510/499

(58) Field of Classification Search ..... 510/161, 510/214, 238, 253, 300, 320, 392, 382, 432, 510/480, 499
See application file for complete search history.

(56) References Cited

U.S. PATENT DOCUMENTS

| | | | | |
|---|---|---|---|---|
| 3,790,482 | A | | 2/1974 | Jones et al. |
| 3,929,678 | A | | 12/1975 | Laughlin et al. |
| 3,961,754 | A | | 6/1976 | Kuhns et al. |
| 4,211,517 | A | | 7/1980 | Schmid |
| 4,212,761 | A | | 7/1980 | Ciaccio |
| 4,238,345 | A | | 12/1980 | Guilbert |
| 4,243,543 | A | | 1/1981 | Guilbert et al. |
| 4,261,868 | A | | 4/1981 | Hora et al. |
| 4,462,922 | A | | 7/1984 | Boskamp |
| 4,481,167 | A | | 11/1984 | Ginter et al. |
| 4,537,706 | A | | 8/1985 | Severson, Jr. |
| 4,595,520 | A | | 6/1986 | Heile et al. |
| 4,608,189 | A | | 8/1986 | Koch et al. |
| 4,670,179 | A | | 6/1987 | Inamorato et al. |
| 4,680,134 | A | | 7/1987 | Heile et al. |
| 4,690,305 | A | | 9/1987 | Copeland |
| 4,749,508 | A | | 6/1988 | Cockrell, Jr. et al. |
| 4,826,661 | A | | 5/1989 | Copeland et al. |
| 4,836,951 | A | | 6/1989 | Totten et al. |
| 4,845,965 | A | | 7/1989 | Copeland et al. |
| 4,858,449 | A | | 8/1989 | Lehn |
| 4,877,459 | A | | 10/1989 | Cockrell, Jr. et al. |
| 4,983,315 | A | | 1/1991 | Glogowski et al. |
| 5,008,030 | A | | 4/1991 | Cook et al. |
| 5,019,292 | A | * | 5/1991 | Baeck et al. ..... 510/330 |
| 5,064,561 | A | | 11/1991 | Rouillard |
| 5,118,426 | A | | 6/1992 | Duncan et al. |
| 5,122,538 | A | | 6/1992 | Lokkesmoe et al. |
| 5,124,066 | A | | 6/1992 | Russell |
| 5,173,207 | A | | 12/1992 | Drapier et al. |
| 5,223,179 | A | | 6/1993 | Connor et al. |
| 5,234,719 | A | | 8/1993 | Richter et al. |
| 5,292,525 | A | | 3/1994 | Brenden et al. |
| 5,395,541 | A | | 3/1995 | Carpenter et al. |
| 5,407,700 | A | | 4/1995 | Man et al. |
| 5,449,619 | A | | 9/1995 | Griffin et al. |
| 5,451,336 | A | | 9/1995 | Schwadtke et al. |
| 5,494,817 | A | | 2/1996 | Chen |
| 5,571,446 | A | | 11/1996 | Rouillard |
| 5,578,134 | A | | 11/1996 | Lentsch et al. |
| 5,648,329 | A | | 7/1997 | Blake et al. |
| 5,797,986 | A | | 8/1998 | Rolando et al. |
| 5,827,813 | A | * | 10/1998 | Hartman et al. ..... 510/443 |
| 5,851,973 | A | | 12/1998 | Foley |
| H1776 | H | | 1/1999 | Linard et al. |
| 5,858,117 | A | | 1/1999 | Oakes et al. |
| 5,858,299 | A | | 1/1999 | Fernholz et al. |
| 5,858,941 | A | | 1/1999 | Oakes et al. |
| 5,861,366 | A | | 1/1999 | Ihns et al. |
| 5,863,874 | A | | 1/1999 | Person Hei et al. |
| 5,863,882 | A | | 1/1999 | Lin et al. |
| 5,871,590 | A | | 2/1999 | Hei et al. |
| 5,876,514 | A | | 3/1999 | Rolando et al. |
| 5,883,062 | A | | 3/1999 | Addison et al. |
| 5,935,271 | A | * | 8/1999 | Lappas et al. ..... 8/137 |
| 6,004,922 | A | | 12/1999 | Watson et al. |
| 6,008,178 | A | | 12/1999 | Baillely et al. |
| 6,015,781 | A | | 1/2000 | Vinson et al. |
| 6,017,864 | A | | 1/2000 | Brittain et al. |

(Continued)

FOREIGN PATENT DOCUMENTS

| | | |
|---|---|---|
| CA | 2267331 | 4/1998 |

(Continued)

OTHER PUBLICATIONS

"Improvement in Slip Resistance/Coefficient of Friction in Field Tests using Wash 'n Walk™," *Technical Performance Bulletin*, Ecolab, 1 page (Dec. 18, 2003).

(Continued)

*Primary Examiner*—Charles I Boyer
(74) *Attorney, Agent, or Firm*—Merchant & Gould P.C.

(57) ABSTRACT

The invention relates to an enzyme stabilization system, compositions with the enzyme stabilization system, and methods of using the enzyme composition. Preferred ratios of acid to amine are effective at stabilizing enzyme. Optional nonionic surfactants and solvents also positively contribute to enzyme stability. The compositions are useful in cleaning applications.

11 Claims, No Drawings

U.S. PATENT DOCUMENTS

| | | | | |
|---|---|---|---|---|
| 6,017,872 | A | 1/2000 | Pedersen et al. | |
| 6,020,303 | A | 2/2000 | Cripe et al. | |
| 6,025,316 | A | 2/2000 | Cao et al. | |
| 6,046,150 | A | 4/2000 | Choy et al. | |
| 6,060,444 | A | 5/2000 | Schulz et al. | |
| 6,071,356 | A | 6/2000 | Olsen | |
| 6,121,219 | A | 9/2000 | Herdt et al. | |
| 6,150,324 | A | 11/2000 | Lentsch et al. | |
| 6,165,965 | A | 12/2000 | Schalitz et al. | |
| 6,180,585 | B1 | 1/2001 | Schalitz et al. | |
| 6,191,092 | B1 * | 2/2001 | Bragulla et al. | 510/392 |
| 6,197,739 | B1 | 3/2001 | Oakes et al. | |
| 6,221,825 | B1 * | 4/2001 | Williams et al. | 510/320 |
| 6,258,765 | B1 | 7/2001 | Wei et al. | |
| 6,339,054 | B1 | 1/2002 | Levitt et al. | |
| 6,350,607 | B1 | 2/2002 | Cooney, Jr. | |
| 6,376,451 | B1 | 4/2002 | Teasdale et al. | |
| 6,387,874 | B1 | 5/2002 | Schalitz et al. | |
| 6,425,959 | B1 | 7/2002 | Man | |
| 6,498,137 | B1 | 12/2002 | Schalitz et al. | |
| 6,506,261 | B1 | 1/2003 | Man | |
| 6,624,132 | B1 | 9/2003 | Man et al. | |
| 6,632,291 | B2 | 10/2003 | Rabon et al. | |
| 6,638,902 | B2 | 10/2003 | Tarara et al. | |
| 6,653,266 | B2 | 11/2003 | Wei et al. | |
| 6,673,760 | B1 | 1/2004 | Lentsch et al. | |
| 6,689,223 | B1 | 2/2004 | Meine et al. | |
| 6,900,167 | B2 | 5/2005 | Griese et al. | |
| 6,903,062 | B2 | 6/2005 | Griese et al. | |
| 7,179,780 | B2 * | 2/2007 | Forth et al. | 510/393 |
| 2002/0173437 | A1 | 11/2002 | Rabon et al. | |
| 2002/0177541 | A1 | 11/2002 | Tarara et al. | |
| 2002/0182184 | A1 | 12/2002 | Pearl et al. | |
| 2003/0017955 | A1 * | 1/2003 | Forth et al. | 510/296 |
| 2003/0022806 | A1 | 1/2003 | Wei et al. | |
| 2003/0040458 | A1 | 2/2003 | Olson et al. | |
| 2003/0049832 | A1 | 3/2003 | Tisinger et al. | |
| 2003/0087787 | A1 | 5/2003 | Man et al. | |
| 2003/0126688 | A1 | 7/2003 | Peters et al. | |
| 2003/0220223 | A1 * | 11/2003 | Scheuing et al. | 510/475 |
| 2004/0072715 | A1 | 4/2004 | Griese et al. | |
| 2004/0106535 | A1 | 6/2004 | Wei et al. | |
| 2004/0121932 | A1 | 6/2004 | Griese et al. | |
| 2004/0142840 | A1 * | 7/2004 | de Buzzaccarini et al. | 510/296 |
| 2005/0020466 | A1 | 1/2005 | Man et al. | |
| 2005/0176618 | A1 | 8/2005 | Biering et al. | |
| 2005/0215448 | A1 * | 9/2005 | Evers et al. | 510/238 |
| 2006/0089294 | A1 * | 4/2006 | Depoot et al. | 510/515 |
| 2006/0100122 | A1 | 5/2006 | Baars et al. | |
| 2006/0135391 | A1 * | 6/2006 | Scheibel et al. | 510/421 |
| 2006/0247150 | A1 * | 11/2006 | Molinaro et al. | 510/499 |
| 2007/0099816 | A1 * | 5/2007 | Scheuing et al. | 510/475 |
| 2008/0015135 | A1 * | 1/2008 | de Buzzaccarini et al. | 510/336 |
| 2008/0032909 | A1 * | 2/2008 | de Buzzaccarini et al. | 510/293 |

FOREIGN PATENT DOCUMENTS

| | | |
|---|---|---|
| EP | 0348183 | 12/1989 |
| EP | 0451924 | 10/1991 |
| EP | 0481542 | 4/1992 |
| EP | 0501375 | 9/1992 |
| EP | 0384666 | 11/1994 |
| GB | 1224564 | 3/1971 |
| GB | 2140818 | 12/1984 |
| GB | 2200132 | 7/1988 |
| GB | 2271120 | 4/1994 |
| GB | 2393907 | 4/2004 |
| WO | WO93/21299 | 10/1993 |
| WO | WO95/00621 | 1/1995 |
| WO | WO96/06910 | 3/1996 |
| WO | WO96/41859 | 12/1996 |
| WO | WO97/02753 | 1/1997 |
| WO | WO97/05227 | 2/1997 |
| WO | WO97/07190 | 2/1997 |
| WO | WO98/54285 | 12/1998 |
| WO | WO99/47631 | 9/1999 |
| WO | WO2004/020560 | 3/2004 |

OTHER PUBLICATIONS

"Material Safety Data Sheet," Novozymes Biologicals, Inc., pp. 1-4 (Jan. 4, 2005).

"Novo Grease Guard. Grease Degrading Formulation with an Innovative BioS™," Novozymes, 4 pages (Nov. 1, 2004).

"Wash 'n Walk™. Real Customers. Real Results," 8 pages (Date Unknown).

Arledge, R., "Slip and Fall Survey for Applebee's Augusta Road," Liberty Mutual, pp. 1-10 (May 12, 2004).

Genencor International®, Purafect® MAL, Genencor® Alkaline Protease, Product Information, www.genencor.com, 2 pages (Nov. 2003).

*Hawley's Condensed Chemical Dictionary*, 12th Edition, Von Nostrand Reinhold Company, p. 176 (1993).

International Search Report dated Oct. 26, 2001.

Morris, T. et al., "Formulating Liquid Detergents for Multiple Enzyme Stability," Cognis Corporation, Ambler, PA, www.Happi.com, pp. 92-98 (Jan. 2004).

Novozymes A/S, Detergent/2001-04366-04.pdf Application Sheet, Novozymes Proteases for Laundry Detergents, pp. 1-7 (May 24, 2002).

Novozymes A/S, Detergent/2002-00806-01.pdf Application Sheet, Application of Savinase® Ultra & Alcalase® Ultra, pp. 1-6 (May 23, 2002).

* cited by examiner

STABLE AQUEOUS ANTIMICROBIAL ENZYME COMPOSITIONS COMPRISING A TERTIARY AMINE ANTIMICROBIAL

FIELD OF THE INVENTION

This invention is in the field of enzyme stabilization systems, stable, aqueous, antimicrobial enzyme compositions, and their methods of use. The compositions are useful in cleaning applications.

BACKGROUND

Multiple soils are present in institutional settings. In the foodservice industry, food soils include protein, fats and oils, and starches. These soils end up on hard surfaces in a kitchen and restaurant such as the floors, walls, countertops, and dishes. They also end up on soft surfaces like bar rags, towels, and mop heads. Some soils can be quite stubborn to remove and require aggressive cleaning products. There is a need for effective cleaning products that don't rely on aggressive chemicals. Enzymes present an alternative to aggressive chemistries. But, a challenge to enzymes is maintaining their stability in solution in the presence of water or incompatible chemistries. Enzymes are generally unstable in solution without a stabilizing system. Enzyme instability in solution results from (1) incompatible chemistry like surfactants and antimicrobials denaturing the enzyme, or (2) autolysis in the presence of protease where the protease attacks other enzymes. Enzyme stabilization systems exist but have drawbacks. For example, boric acid or borate stabilization systems are restricted in certain countries. It is against this background that this invention is made.

SUMMARY

This invention relates to an enzyme stabilization system, a composition that includes the enzyme stabilization system, and methods of using the enzyme composition. Surprisingly, it has been discovered that preferred ratios of acid to amine are effective at stabilizing enzymes. Nonionic surfactants and solvent also positively contribute to enzyme stability. The amine may be an antimicrobial amine. When used together, these materials form a stable enzyme system that is useful in cleaning applications.

DETAILED DESCRIPTION OF SOME EMBODIMENTS

This invention relates to an enzyme stabilization system (referred to as the "system"), a composition that includes the enzyme stabilization system (referred to as the "composition"), and methods of using the resulting composition. Surprisingly, it has been discovered that preferred ratios of acid to amine are effective at stabilizing enzymes. Nonionic surfactants and solvents also positively contribute to enzyme stability. The amine may be an antimicrobial amine. When used together, these materials form a stable enzyme system that is useful in compositions for cleaning applications.

When a monoprotic acid is used, the monoprotic acid and amine are present in the enzyme system in a molar ratio of about 1:2.3-1:14.25, 1:5-1:10, or 1:6.25-1:8.75. When a diprotic acid is used, the diprotic acid and amine present in the enzyme system in a molar ratios of about 1:1.15-1:7.1, 1:2.5-1:5, or 1:3.2-1:4.5. Other acids may be used as well and a person skilled in the art will be able to calculate the preferred ratio of acid to amine.

The systems and concentrate composition should have a pH from about 4.9 to about 9.45, about 5.3 to about 7.7, or about 5.5 to about 7.5.

A system and concentrate composition with the acid/amine ratio and pH ranges described above should create a stable enzyme system and composition—even in the presence of other ingredients or materials—where the enzyme retains at least about 15%, 30%, or 45% of its initial enzyme activity after 21 days at 40° C. Enzyme activity is determined by a colorimetric lipase activity assay such as the QUANTICHROM™ Lipase Assay Kit (DLPS-100) (BioAssay Systems, Hayward, Calif.). The assay works by measuring enzymatic hydrolysis of a triglyceride surrogate that produces a chromophore upon hydrolysis. The concentration of the chromophore is measured at 2 separate time points so a rate can be determined for the reaction. The rate is matched against the hydrolysis rate of a known concentration of enzyme as a standard.

The stabilized enzyme system may be used in a composition. The composition may be a multiple-use solid block (i.e., a 500 gram puck to a 20 kg block, or a 1 kg block to a 6 kg block), a single-use tablet, a powder, a granulate, a pellet (where the difference between powder, granulate, and pellet is particle size), a liquid concentrate, a liquid ready-to-use composition, a thickened liquid, an emulsion, a gel, a paste or other physical forms. The composition is preferably a liquid ready-to-use composition. A concentrate refers to a composition that is diluted to form a ready-to-use composition. A ready-to-use composition refers to a composition that is applied to the surface to be cleaned.

The Stabilized Enzyme System

The stabilized enzyme system includes enzyme, acid, antimicrobial amine, and optionally a nonionic surfactant, aminocarboxylate, or solvent.

Enzyme

The system includes at least one enzyme but may include any number of enzymes. The enzyme may include a protease, amylase, lipase, gluconase, cellulase, peroxidase, a combination, or other enzymes. The system preferably includes at least one lipase. The enzymes may be vegetable, animal, bacterial, fungal or yeast enzymes, or genetic variations thereof. The enzyme should be selected based on factors like pH, stability, temperature, and compatibility with materials found in detergent compositions and cleaning applications. Preferred enzymes have activity in the pH range of about 2-14 or 6-12 and at temperatures from about 20° C. to 80° C. The enzyme may be a wild type enzyme or a recombinant enzyme. Preferred enzymes have a broad spectrum of activity and a high tolerance for materials found in cleaning compositions like alkalinity, acidity, chelating agents, sequestering agents, and surfactants.

The enzyme concentration in the system depends on the particular enzyme's activity. The enzyme concentration can range from about 0.25 to about 10.0 wt. %, about 0.5 to about 5.0 wt. %, or about 1.0 to about 2.0 wt. % of a commercially available enzyme product. A person skilled in the art will be able to determine the enzyme concentration after selecting a desired enzyme based on the enzyme's activity and profile.

Exemplary enzymes are listed below:

Protease

Protease isolated from: *Bacillus lentus, Bacillus licheniformis, Bacillus amyloliquefaciens*, and the like.

Commercially Available Protease:
SAVINASE® (Novo Industries A/S—Denmark)
MAXACAL® (Gist-Brocades—Netherlands)
OPTICLEAN® (Solvay Enzymes)
DURAZYM® (Novo Industries A/S—Denmark)
PROPERASE® (Genencor International)
ALCALASE® (Novo Industries A/S—Denmark)
MAXATASE® (Gist-Brocades—Netherlands)
PRIMASE® (Novo Industries A/S—Denmark)

Amylase

Amylase isolated from: *Bacillus licheniformis, Bacillus amyloliquefaciens, Bacillus subtilis, Bacillus stearothermophilus*, and the like.

Commercially Available Amylase:
TERMAMYL® (Novo Industries A/S—Denmark)
RAPIDASE® (Gist-Brocades—Netherlands)
FUNGAMYL® (Novo Industries A/S—Denmark)
DURAMYL® (Novo Industries A/S—Denmark)
PURASTAR STL® (Genencor International)
PURASTAR OXAM® (Genencor International)

Cellulase

Cellulase isolated from: *Humicola insolens, Humicola* strain DSM 1800, cellulase 212-producing fungus of the genus *Aeromonas*, cellulase extracted from the hepatopancrease of the marine mollusk *Dorabella Auricula* Solander, and the like.

Commercially Available Cellulase:
CAREZYME® (Novo Industries A/S—Denmark)
CELLUZYME® (Novo Industries A/S—Denmark)

Lipase

Lipase isolated from: *Pseudomona, Pseudomonas stutzeri* ATCC 19.154, *Humicola, Humicola lanuginose* (reproduced recombinantly in *Aspergillus oryzae*), *Chromobacter viscosum, Pseudomonas gladioli, Humicola lanuginose*, and the like.

Commercially available lipase:
Lipase P "AMANO"® (Amano Pharmaceutical—Japan)
"AMANO-P"® (Amano Pharmaceutical—Japan)
LIPOLASE® (Novo Industries A/S—Denmark)
AMANO-CES® (Toyo Jozo Co.—Japan)
Lipex 100 L (Novi industries A/S Denmark)

Other Enzymes

Peroxidase (horseradish peroxidase)

Ligninase

Haloperoxidase (chloroperoxidase, bromoperoxidase)

Gluconase

Acid

The system includes at least one acid. The acid may be organic or inorganic. The acid is preferably an organic acid. The composition may include one acid or any number of acids.

The acid concentration can range in the system from about 0.5 to about 8.5 wt. %, about 1.0 to about 6.0 wt. %, or about 1.25 to about 5.25 wt. %. Preferred organic acids include acetic acid and $C_1$ to $C_8$ mono or dicarboxylic acids. But, other exemplary acids are listed below:

Organic Monocarboxylic Acids hydroxyacetic (glycolic) acid citric acid formic acid acetic acid propionic acid butyric acid valeric acid caproic acid gluconic acid itaconic acid trichloroacetic acid benzoic acid levulenic acid Organic Dicarboxylic Acids oxalic acid malonic acid succinic acid glutaric acid maleic acid fumaric acid adipic acid terephthalic acid Inorganic Acids phosphoric acid sulfuric acid sulfamic acid methylsulfamic acid hydrochloric acid hydrobromic acid nitric acid Antimicrobial Amine The system includes an antimicrobial amine. The amine may be a primary, secondary, or tertiary amine. Alternatively, the composition can include a quaternary ammonium compound. The amine concentration in the system can range from about 0.5 to about 8.5 wt. %, about 1.0 to about 3.0 wt. %, or about 1.25 to about 2.0 wt. %. The amine is preferably a tertiary amine. But, other exemplary antimicrobial amines are listed below:

aliphatic amines aliphatic amine salts such as: aliphatic ammonium salts ether amines such as:

those commercially available from Tomah Products as PA-19, PA-1618, PA-1816, DA-18, DA-19, DA-1618, DA-1816, or ether amines with the formulas $R_1$—O—$R_2$—$NH_2$, $R_1$—O—$R_2$—NH—$R_3$—$NH_2$, or mixtures thereof, where (independently)

$R_1$=a linear saturated or unsaturated $C_6$-$C_{18}$ alkyl
$R_2$=a linear or branched $C_1$-$C_8$ alkyl, and
$R_3$=a linear or branched $C_1$-$C_8$ alkyl, or
$R_1$=a linear $C_{12}$-$C_{16}$ alkyl $R_2$=a $C_2$-$C_6$ linear or branched alkyl; and $R_3$=a $C_2$-$C_6$ linear or branched alkyl, or $R_1$=a linear alkyl $C_{12}$-$C_{16}$, or a mixture of linear alkyl $C_{10}$-$C_{12}$ and $C_{14}$-$C_{16}$ $R_2$=$C_3$, and $R_3$=$C_3$ ether amine salts such as: ether ammonium salts diamines such as:

N-coco-1,3-propylene diamine (such as Duomeen®—Akzo Chemie America, Armak Chemicals)

N-oleyl-1,3-propylene diamine (such as Duomeen®—Akzo Chemie America, Armak Chemicals)

N-tallow-1,3-propylene diamine (such as Duomeen®—Akzo Chemie America, Armak Chemicals)

diamine salts such as:

diamine acetate (or other counterion), or diamine sales with the formulas $[(R_1)NH(R_2)NH_3]^+(CH_3COO)^-$ or $[R_1)NH_2(R_2)NH_3^{++}](CH_3COO)_2^-$ where $R_1$=a $C_{10}$-$C_{18}$ aliphatic group or an ether group having the formula $R_{10}OR_{11}$ where $R_{10}$=a $C_{10}$-$C_{18}$ aliphatic group and $R_{11}$=a $C_1$-$C_5$ alkyl group; and $R_2$=a $C_1$-$C_5$ alkylene group, or $R_1$=a $C_{10}$-$C_{18}$ aliphatic group derived from a fatty acid, and $R_2$=propylene Nonionic Surfactant The system optionally includes a nonionic surfactant. Nonionic surfactants include a hydrophobic group and a hydrophilic group. They are typically produced by the condensation of an organic aliphatic, alkyl aromatic, or polyoxyalkylene hydrophobic compound with a hydrophilic alkaline oxide moiety such as ethylene oxide. The length of the hydrophilic group can be adjusted to influence the hydrophobic/hydrophilic balance of the molecule. The nonionic surfactant has been found to enhance the enzyme stability in the system in combination with the amine biocide. The nonionic surfactant concentration in the system can range from about 0.1 to about 40 wt. %, from about 5 to about 30 wt. %, or from about 7.5 to about 20 wt. %. The nonionic surfactant is preferably a linear alcohol ethoxylate. But, other exemplary nonionic surfactants are listed in the treatise Nonionic Surfactants, edited by Schick, M. J., Vol. 1 of the Surfactant Science Series, Marcel Dekker, Inc., New York, 1983. Also a typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). The following list is also exemplary:

Block polyoxypropylene-polyoxyethylene polymeric compounds based upon propylene glycol, ethylene glycol, glycerol, trimethylolpropane, and ethylenediamine as the initiator reactive hydrogen compound such as: difunctional block copolymers (Pluronic® products—BASF Corp.); and tetra-functional block copolymers (Tetronic® products—BASF Corp.)

Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. (Igepal®—Rhone-Poulenc and Triton®—Union Carbide)

Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. (Neodol®—Shell Chemical Co. and Alfonic®—Vista Chemical Co)

Condensation products of one mole of saturated or unsaturated, straight or branched chain carboxylic acid having from about 8 to about 18 carbon atoms with from about 6 to about 50 moles of ethylene oxide. The acid can be a mixture of acids in the above defined carbon atoms range or it can be an acid having a specific number of carbon atoms within the range. (Nopalcol®—Henkel Corporation and Lipopeg®—Lipo Chemicals, Inc.)

Alkanoic acid esters formed by reaction with glycerides, glycerin, and polyhydric (saccharide or sorbitan/sorbitol) alcohols. All of these ester moieties have one or more reactive hydrogen sites on their molecule which can undergo further acylation or ethylene oxide (alkoxide) addition to control the hydrophilicity of these substances.

Low Foaming Nonionic Surfactants

Reverse block copolymers which are block copolymers, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. Includes difunctional reverse block copolymers (Pluronic® R—BASF Corp.) and tetra-functional reverse block copolymers (Tetronic® R—BASF Corp.)

Capped nonionic surfactants which are modified by "capping" or "end blocking" the terminal hydroxy group or groups (of multifunctional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

The alkylphenoxypolyethoxyalkanols of U.S. Pat. No. 2,903,486 issued Sep. 8, 1959 to Brown et al. and represented by the formula

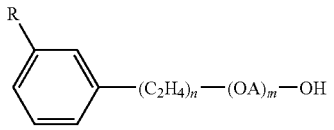

where

R=an alkyl group of 8 to 9 carbon atoms;

A=an alkylene chain of 3 to 4 carbon atoms;

n=an integer of 7 to 16; and m=an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ where Z=an alkoxylatable material;

R=a radical derived from an alkaline oxide which can be ethylene and propylene;

n=an integer from 10 to 2,000 or more; and z=an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_m$ H where Y=the residue of organic compound having from about 1 to 6 carbon atoms and one reactive hydrogen atom;

n=an average value of at least about 6.4, as determined by hydroxyl number; and m=a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ where Y=the residue of an organic compound having from about 2 to 6 carbon atoms and containing x reactive hydrogen atoms where x has a value of at least about 2;

n=a value such that the molecular weight of the polyoxypropylene hydrophobic base is at least about 900; and m=a value such that the oxyethylene content of the molecule is from about 10% to about 90% by weight.

Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents correspond to the formula:

$P[(C_3H_6O)_n(C_2H_4O)_mH]_n$ where

P=the residue of an organic compound having from about 8 to 18 carbon atoms and containing x reactive hydrogen atoms where x has a value of 1 or 2;

n=a value such that the molecular weight of the polyoxyethylene portion is at least about 44; and m=a value such that the oxypropylene content of the molecule is from about 10% to about 90% by weight. In either case the oxypropylene chains may optionally contain small amounts of ethylene oxide and the oxyethylene chains may also optionally contain small amounts of propylene oxide.

Polyhydroxy fatty acid amide surfactants include those having the structural formula $R^2CONR^1Z$ where $R^1$=H, $C_1$-$C_4$ hydrocarbyl, 2-hydroxy ethyl, 2-hydroxy propyl, ethoxy, propoxy group, or a mixture thereof;

$R^2$=a $C_5$-$C_{31}$ hydrocarbyl, which can be straight-chain; and

Z=a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

The alkyl ethoxylate condensation products of aliphatic alcohols with from about 0 to about 25 moles of ethylene oxide. The alkyl chain of the aliphatic alcohol can either be straight or branched, primary or secondary, and generally contains from 6 to 22 carbon atoms.

The ethoxylated $C_6$-$C_{18}$ fatty alcohols and $C_6$-$C_{18}$ mixed ethoxylated and propoxylated fatty alcohols. Suitable ethoxylated fatty alcohols include the $C_{10}$-$C_{18}$ ethoxylated fatty alcohols with a degree of ethoxylation of from 3 to 50.

Nonionic alkylpolysaccharide surfactants include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Fatty acid amide surfactants include those having the formula $R^6CON(R^7)_2$ where $R^6$=an alkyl group containing from 7 to 21 carbon atoms; and each $R^7$=independently hydrogen, $C_1$-$C_4$ alkyl, $C_1$-$C_4$ hydroxyalkyl, or —$(C_2H_4O)_xH$, where x=from 1 to 3.

Another class of nonionic surfactants include the class defined as alkoxylated amines or, most particularly, alcohol alkoxylated/aminated/alkoxylated surfactants. These nonionic surfactants may be at least in part represented by the general formulae:

$R^{20}$—$(PO)_sN$-$(EO)_tH$, $R^{20}$—$(PO)_sN$-$(EO)_tH(EO)_tH$, and $R^{20}$—$N(EO)_tH$; where $R^{20}$=an alkyl, alkenyl or other aliphatic group, or an alkyl-aryl group of from 8 to 20, preferably 12 to 14 carbon atoms, EO=oxyethylene, PO=oxypropylene, s=1-20, preferably 2-5, t=1-10, preferably 2-5, and u=1-10, preferably 2-5.

Other variations on the scope of these compounds may be represented by the alternative formula $R^{20}$—$(PO)_v$—$N[(EO)_wH][(EO)_zH]$, where $R^{20}$=an alkyl, alkenyl or other aliphatic group, or an alkyl-aryl group of from 8 to 20, preferably 12 to 14 carbon atoms, v=1 to 20 (e.g., 1, 2, 3, or 4 (preferably 2)), and w and z=independently 1-10, preferably 2-5.

These compounds are represented commercially by a line of products sold by Huntsman Chemicals as nonionic surfactants. A preferred chemical of this class includes Surfonic™ PEA 25 Amine Alkoxylate.

Semi-Polar Nonionic Surfactants

Amine oxides are tertiary amine oxides corresponding to the general formula:

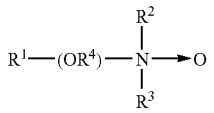

where the arrow=a conventional representation of a semi-polar bond; and, $R^1$, $R^2$, and $R^3$ may be aliphatic, aromatic, heterocyclic, alicyclic, or combinations thereof.

Generally, for amine oxides of detergent interest, $R^l$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl)amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Semi-polar nonionic surfactants also include the water soluble phosphine oxides having the following structure:

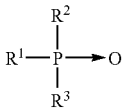

where the arrow=a conventional representation of a semi-polar bond;

$R^l$=an alkyl, alkenyl or hydroxyalkyl moiety ranging from 10 to about 24 carbon atoms in chain length; and $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants also include the water soluble sulfoxide compounds which have the structure:

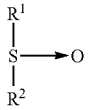

where the arrow=a conventional representation of a semi-polar bond;

$R^l$=an alkyl or hydroxyalkyl moiety of about 8 to about 28 carbon atoms, from 0 to about 5 ether linkages and from 0 to about 2 hydroxyl substituents; and $R^2$=an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Aminocarboxylate

The system optionally includes a chelating agent. If included, the chelating agent may be present in a range from about 0.01 to about 20 wt. %, from about 0.1 to about 10 wt. %, or from about 1.0 to about 5.0 wt. %. The chelating agent is preferably a biodegradable aminocarboxylate such as MGDA, GLDA, or IDS. But, other exemplary chelating agents are listed below:

ethanoldiglycine or a salt thereof, such at disodium ethanoldiglycine ($Na_2EDG$)

methylgylcinediacetic acid or a salt thereof such as trisodium methylgylcinediacetic acid, (Trilon M (40% MGDA)—BASF Corp.);

iminodisuccinic acid or a salt thereof such as iminodisuccinic acid sodium salt (IDS—Lanxess, Leverkusen, Germany);

N,N-bis(carboxylatomethyl)-L-glutamic acid (GLDA) or a salt thereof such as iminodisuccinic acid sodium salt (GLDA-$Na_4$) (Dissolvine GL-38 (38% GLDA)—Akzo Nobel);

[S—S]-ethylenediaminedisuccinic acid (EDDS) or a salt thereof such as a sodium salt of [S13 ]-ethylenediaminedisuccinic acid;

3-hydroxy-2,2'-iminodisuccinic acid (HIDS) or a salt thereof such as tetrasodium 3-hydroxy-2,2'-iminodisuccinate (HIDS 50%—Innospec Performance Chemicals);

nitrilotriacetic acid (NTA) or a salt thereof; and ethylenediaminetetraacetic acid (EDTA) or a salt thereof.

Solvent

The system optionally includes a solvent or combination or solvents. The solvent has been found to positively contribute to the enzyme stability when used as part of the enzyme stabilizing system with other materials. As an optional ingredient the solvent concentration in the system can range from about 1.0 to about 20.0 wt. %, from about 3.0 to about 15.0 wt. %, and from about 5.0 to about 10.0 wt. %. The solvent is preferably a glycol ether such as dipropylene glycol methyl ether. But, other exemplary solvents are listed below:

Alcohols methanol ethanol propanol butanol, and the like, as well as mixtures thereof.

Polyols glycerol glycol ethers ethylene glycol propylene glycol diethylene glycol, and the like, as well as mixtures thereof.

If a solvent and surfactant are both present in the system, they are preferably present together in a concentration so that the ratio of solvent and surfactant to amine ([solvent+surfactant]:amine) ranges from about 1:1 to about 25.4:1, from about 2:1 to about 11:1, and from about 3:1 to about 6:1.

Cleaning Compositions With the Stabilized Enzyme System

The stabilized enzyme system can be incorporated into a composition such as a cleaning composition. The cleaning composition can be used as a laundry detergent, sanitizer or laundry pre-soak, a manual or automatic dishwashing or warewashing detergent or sanitizer, a sanitizer or detergent for medical instruments and equipment including manual instrument applications and automatic endoscope reprocessors, a floor cleaning composition, a clean-in-place composition (i.e., for cleaning food and beverage or pharmaceutical equipment), and the like. The system can also be incorporated into an antimicrobial composition, for example in a peracid, chlorine, acidified sodium chlorite, amine, quaternary ammonium compound, or fatty acid composition.

When the system is incorporated into a cleaning composition the enzyme system can be included in a concentrate composition at a concentration of about 1 to about 60 wt. %, about 5 to about 45 wt. %, or about 10 to about 30 wt. %. These wt. % ranges are exemplary and will vary slightly depending on what is included in the enzyme system. The exemplary wt. % ranges above assume that the enzyme system includes at least the enzyme, amine, nonionic surfactant, and solvent.

Besides the enzyme system, the cleaning composition can include a number of materials such as a source of acid or alkalinity, additional surfactants, (i.e. anionic, nonionic, or caltonic) defoamers, additional antimicrobial agents, viscosity modifiers, bleaching agents, dyes and fragrances, additional chelating agents, spores and the like.

Spores

The composition optionally includes spores. Spores are useful in certain applications because they can provide an ongoing enzyme effect. For example, in floorcare applications or laundry pre-treatment applications, the enzyme may provide the initial activity, but if the system remains on the surface, the spore may continue to generate new enzymes that continue to break down a desired soil for hours, days, or weeks.

Spores are similar to enzymes in that they are sensitive to pH, temperature, and the chemistry in the surrounding environment. The enzyme stabilization system also helps to stabilize the spore in composition. The activity of the spore also varies depending on which spore is selected and a person skilled in the art should be able to select a desired spore based on the preferred activity level at a given pH and temperature range. Preferred spores have activity in the pH range of 2-14 or 6-12 and at temperatures from about 20° C. to 80° C. Preferred spores have a broad spectrum of activity and a high tolerance for materials found in cleaning compositions like alkalinity, acidity, chelating agents, sequestering agents, and surfactants.

The spore concentration in the system can range from about 0.001 to about 1 wt. %, from about 0.005 to about 0.5 wt. %, and from about 0.1 to about 0.3 wt. % of a commercially available spore composition. The spore preferably generates the enzymes also used in the formula.

Methods of Using the Cleaning Composition

The system may be incorporated into a cleaning composition like a laundry detergent or laundry pre-soak, manual or automatic dishwashing or warewashing detergent, floor cleaning composition, hard surface composition, or clean-in-place composition (i.e., for cleaning food and beverage or pharmaceutical equipment).

The system is especially useful in the foodservice business on food soils. When a lipase is included in the system, the system and compositions are useful in removing fats and oils off of hard and soft surfaces in a kitchen. Fats and oils in a kitchen build up over time, eventually forming a hard coating on surfaces. Floor tiles and back splashes near cooking surfaces eventually develop a sheen to them because of the hardened layers of fat and oil. Grout becomes discolored as fat and oil soils become embedded into the grout. Bar rags and mop heads accumulate fat and oil soils over time. In addition to having soil buildup, the foodservice industry needs to prevent outbreaks of food illness like *E. coli* and *Salmonella*. The invention is especially useful in this industry because of its ability to remove food soils and its antimicrobial properties.

Exemplary floor cleaning compositions include compositions for use in manual (i.e., mop and bucket) applications or in an automatic floor cleaning machines such as those manufactures by Tennant, Clarke and others. When used in an automatic floor cleaning machine, the composition provides the additional benefit of maintaining the cleanliness of the inside of the machine through the action of the enzyme and preventing odor and bacterial growth in the machine because of the antimicrobial properties.

Foodservice industries often collect bar rags, towels, and mop heads in a bucket that includes a laundry pre-treatment composition. The compositions may be used as a pre-treatment composition in the foodservice industry. The compositions are advantageous here because they can begin to break down food soils before the laundry even goes into the laundry machine.

When the enzyme system is used in a cleaning composition, it may be incorporated into a concentrate composition where the concentrate is diluted to form the ready-to-use composition. When the concentrate is diluted, it may be diluted in a ratio of concentrate to water of about 1:100-1:20, 1:70-1:30, or 1:50-1:40.

In some embodiments, both the system and the composition are preferably free or substantially free of boric acid or boric acid salts.

DEFINITIONS

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, wt %, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

For a more complete understanding of the invention, the following examples are given to illustrate some embodiment. These examples and experiments are to be understood as illustrative and not limiting. All parts are by weight, except where it is contrarily indicated.

EXAMPLES

The following chart provides a brief explanation of certain chemical components used in the following examples:

TABLE 1

Trade Names and Corresponding Descriptions of Some Chemicals Used in the Examples

| Ingredient | Descriptions | Trademark/Chemical Name |
|---|---|---|
| Nonionic Surfactant | 50:50 blend of alkoxylated alcohol and fatty alcohol polyglycol ether | Plurafac LF-221 (alkoxylated alcohol) (BASF) Dehypon KE 3447 (fatty alcohol polyglycol ether) |
| Solvent | dipropylene glycol methyl ether | Dowanol DPM; Arcosolv DPM; Polysolve DPM; Solvenon DPM (DOW and others) |
| Chelant | methyl glycine diacetic acid, trisodium salt in water | Trilon M (BASF) |
| Amine | N,N-bis(3-aminopropyl)laurylamine | Lonzabac 12.100 (100% active) or Lonzabac 12.30 (30% active) |
| Water | water | softened water |
| Acid | glacial acetic acid | glacial acetic acid (commodity supplied) |
| Enzyme | lipase | Lipex 100 L (Genencor) |

Example 1

Thirty-one experiments were designed to measure the impact of multiple ingredients on enzyme stability. Table 2 lists the 31 compositions. In addition to the materials listed in Table 2, each composition included 1.0 wt. % of a commercial lipase material (Lipex 100 L Genencor) added to it just prior to initiating the enzyme stability test.

TABLE 2

Overall Experiment Design

| Composition | Nonionic Surfactant | Solvent | Chelant | Amine | Water | Acid | pH | Enzyme Activity @ 21 days |
|---|---|---|---|---|---|---|---|---|
| 1 | 0.00 | 0.00 | 10.00 | 0.00 | 86.50 | 3.50 | 2.71 | 0.00 |
| 2 | 0.00 | 0.00 | 10.00 | 5.00 | 85.00 | 0.00 | 3.21 | 0.00 |
| 3 | 0.00 | 15.00 | 0.00 | 0.00 | 81.50 | 3.50 | 4.23 | 0.00 |
| 4 | 0.00 | 15.00 | 0.00 | 5.00 | 80.00 | 0.00 | 4.35 | 0.00 |
| 5 | 0.00 | 15.00 | 10.00 | 0.00 | 75.00 | 0.00 | 4.36 | 0.00 |
| 6 | 30.00 | 0.00 | 0.00 | 0.00 | 66.50 | 3.50 | 4.37 | 0.00 |
| 7 | 30.00 | 0.00 | 0.00 | 5.00 | 65.00 | 0.00 | 4.38 | 0.00 |
| 8 | 30.00 | 0.00 | 10.00 | 0.00 | 60.00 | 0.00 | 4.67 | 0.00 |
| 9 | 30.00 | 15.00 | 0.00 | 0.00 | 55.00 | 0.00 | 4.90 | 0.00 |
| 10 | 30.00 | 11.50 | 0.00 | 5.00 | 50.00 | 3.50 | 4.90 | 41.25 |
| 11 | 0.00 | 4.00 | 0.00 | 2.50 | 90.00 | 3.50 | 4.94 | 0.00 |
| 12 | 30.00 | 6.50 | 10.00 | 0.00 | 50.00 | 3.50 | 5.32 | 0.00 |
| 13 | 30.00 | 0.00 | 10.00 | 5.00 | 53.25 | 1.75 | 5.35 | 15.71 |
| 14 | 10.00 | 0.00 | 0.00 | 0.00 | 90.00 | 0.00 | 5.43 | 43.04 |
| 15 | 0.00 | 15.00 | 10.00 | 5.00 | 66.50 | 3.50 | 5.45 | 44.84 |
| 16 | 15.75 | 0.00 | 0.00 | 5.00 | 75.75 | 3.50 | 5.89 | 24.32 |
| 17 | 15.78 | 7.96 | 4.91 | 0.00 | 69.52 | 1.83 | 6.71 | 0.00 |
| 18 | 19.00 | 15.00 | 10.00 | 2.50 | 50.00 | 3.50 | 6.73 | 26.11 |
| 19 | 30.00 | 0.00 | 5.00 | 5.00 | 56.50 | 3.50 | 6.75 | 56.10 |
| 20 | 0.00 | 0.00 | 3.25 | 5.00 | 90.00 | 1.75 | 6.80 | 0.00 |
| 21 | 25.00 | 15.00 | 5.00 | 5.00 | 50.00 | 0.00 | 7.56 | 0.00 |
| 22 | 10.75 | 15.00 | 10.00 | 0.00 | 60.75 | 3.50 | 8.31 | 0.00 |
| 23 | 7.47 | 6.14 | 4.84 | 1.24 | 79.38 | 0.93 | 8.52 | 38.74 |
| 24 | 22.47 | 9.02 | 5.21 | 1.24 | 59.38 | 2.68 | 9.43 | 19.30 |
| 25 | 13.25 | 15.00 | 0.00 | 5.00 | 63.25 | 3.50 | 10.61 | 45.19 |
| 26 | 15.00 | 0.00 | 10.00 | 5.00 | 66.50 | 3.50 | 10.65 | 54.66 |
| 27 | 25.00 | 15.00 | 5.00 | 5.00 | 50.00 | 0.00 | 11.16 | 0.00 |
| 28 | 30.00 | 15.00 | 0.00 | 0.00 | 55.00 | 0.00 | 11.21 | 0.00 |
| 29 | 0.00 | 15.00 | 10.00 | 5.00 | 66.50 | 3.50 | 11.27 | 45.98 |
| 30 | 0.00 | 0.00 | 10.00 | 0.00 | 86.50 | 3.50 | 11.67 | 0.00 |
| 31 | 10.00 | 0.00 | 0.00 | 0.00 | 90.00 | 0.00 | 12.03 | 39.24 |

For the enzyme stability test, each of the 31 compositions in Table 2 was placed in an environmental chamber at 40° C. These samples were tested colorimetrically for residual enzyme activity at time=0 days, 4 days, 16 days and 21 days. Each of the samples started with the sample amount of enzyme so the relative level of enzyme activity at the end of 21 days demonstrates the stabilizing effect of each of the test compositions.

Example 2

Table 3 highlights the impact of pH on the stability of the lipase enzyme. Table 3 defines the acceptable pH range for this composition being between 4.9 and 9.45 because experiments 10-24 fell within this pH range and for the most part had the best enzyme activity at 21 days. But, Table 3 also shows that pH is not the only factor contributing to stability. Compare specifically, compositions 9 against 10; 14 against 12 and 13; and 22 against 17, 18 and 19 where compositions 9, 14, and 22 fell within this pH range and had an enzyme activity at 21 days of 0.00.

TABLE 3

Impact of pH on Enzyme Stability

| Composition | Amine | Acid | Enzyme Activity @ 21 days | pH | Ratio Amine:Acid |
|---|---|---|---|---|---|
| 1 | 0.00 | 3.50 | 0.00 | 2.71 | 0.00 |
| 2 | 0.00 | 3.50 | 0.00 | 3.21 | 0.00 |
| 3 | 0.00 | 0.00 | 0.00 | 4.23 | 0.00 |
| 4 | 0.00 | 3.50 | 0.00 | 4.35 | 0.00 |
| 5 | 0.00 | 3.50 | 0.00 | 4.36 | 0.00 |
| 6 | 0.00 | 3.50 | 0.00 | 4.37 | 0.00 |
| 7 | 2.50 | 3.50 | 0.00 | 4.38 | 0.71 |
| 8 | 0.00 | 1.83 | 0.00 | 4.67 | 0.00 |
| 9 | 0.00 | 3.50 | 0.00 | 4.90 | 0.00 |
| 10 | 1.24 | 2.68 | 19.30 | 4.90 | 0.46 |
| 11 | 5.00 | 3.50 | 24.32 | 4.94 | 1.43 |
| 12 | 5.00 | 3.50 | 45.19 | 5.32 | 1.43 |
| 13 | 5.00 | 3.50 | 41.25 | 5.35 | 1.43 |
| 14 | 0.00 | 0.00 | 0.00 | 5.43 | 0.00 |
| 15 | 2.50 | 3.50 | 26.11 | 5.45 | 0.71 |
| 16 | 5.00 | 3.50 | 56.10 | 5.89 | 1.43 |
| 17 | 5.00 | 3.50 | 45.98 | 6.71 | 1.43 |
| 18 | 5.00 | 3.50 | 54.66 | 6.73 | 1.43 |
| 19 | 5.00 | 3.50 | 44.84 | 6.75 | 1.43 |
| 20 | 0.00 | 0.00 | 43.04 | 6.80 | 0.00 |
| 21 | 1.24 | 0.93 | 38.74 | 7.56 | 1.33 |
| 22 | 5.00 | 1.75 | 0.00 | 8.31 | 2.86 |
| 23 | 0.00 | 0.00 | 39.24 | 8.52 | 0.00 |
| 24 | 5.00 | 1.75 | 15.71 | 9.43 | 2.86 |
| 25 | 0.00 | 0.00 | 0.00 | 10.61 | 0.00 |
| 26 | 5.00 | 0.00 | 0.00 | 10.65 | 0.00 |
| 27 | 5.00 | 0.00 | 0.00 | 11.16 | 0.00 |
| 28 | 5.00 | 0.00 | 0.00 | 11.21 | 0.00 |
| 29 | 5.00 | 0.00 | 0.00 | 11.27 | 0.00 |
| 30 | 5.00 | 0.00 | 0.00 | 11.67 | 0.00 |
| 31 | 0.00 | 0.00 | 0.00 | 12.03 | 0.00 |

Example 3

Table 4 shows that the ratio of amine to acid positively contributes to enzyme stability. Preferred ratios of amine:acid include those examples that maintain at least 20% enzyme activity over 21 days of storage @ 40° C. (i.e., compositions 11-13, 16-19, 21, 15, and 10 in Table 4). More preferred examples include those compositions that maintained between 20% and 40% enzyme activity (i.e., compositions 11, 21, and 15 in Table 4). The most preferred examples included those compositions maintaining greater than 40% enzyme activity @ 21 days (compositions 12, 13, and 16-19 in Table 4).

TABLE 4

Impact of Weight Ratio of Amine to Acid on Enzyme Stability

| Composition | Amine | Acid | Enzyme Activity @ 21 days | pH | Mole Ratio Amine:Acid |
|---|---|---|---|---|---|
| 22 | 5.00 | 1.75 | 0.00 | 8.31 | 14.24 |
| 24 | 5.00 | 1.75 | 15.71 | 9.43 | 14.24 |
| 11 | 5.00 | 3.50 | 24.32 | 4.94 | 7.12 |
| 12 | 5.00 | 3.50 | 45.19 | 5.32 | 7.12 |
| 13 | 5.00 | 3.50 | 41.25 | 5.35 | 7.12 |
| 16 | 5.00 | 3.50 | 56.10 | 5.89 | 7.12 |
| 17 | 5.00 | 3.50 | 45.98 | 6.71 | 7.12 |
| 18 | 5.00 | 3.50 | 54.66 | 6.73 | 7.12 |
| 19 | 5.00 | 3.50 | 44.84 | 6.75 | 7.12 |
| 21 | 1.24 | 0.93 | 38.74 | 7.56 | 6.63 |
| 15 | 2.50 | 3.50 | 26.11 | 5.45 | 3.56 |
| 10 | 1.24 | 2.68 | 19.30 | 4.90 | 2.30 |

Example 4

Table 5 shows that nonionic surfactant, with the amine, enhances enzyme stability compared to the nonionic surfactant without the amine. Compositions 9 and 12 did not contain amine and had zero enzyme activity at 21 days. In contrast, Compositions 10 and 19 contained amine and both had enzyme activity at 21 days of greater than 40%.

TABLE 5

Impact of Nonionic Surfactant and Amine on Enzyme Stability

| Composition | Nonionic Surfactant | Amine | Enzyme Activity @ 21 days | pH |
|---|---|---|---|---|
| 9 | 30.00 | 0.00 | 0.00 | 5.43 |
| 10 | 30.00 | 5.00 | 41.25 | 5.35 |
| 12 | 30.00 | 0.00 | 0.00 | 4.90 |
| 19 | 30.00 | 5.00 | 56.10 | 5.89 |

Example 5

Table 6 shows that chelating agents decrease enzyme stability. Composition 20 includes a small amount of chelating agent and the enzyme activity at 21 days is zero. In contrast, compositions 10, 14, 16 and 25 without chelating agent retained enzyme activity at 21 days.

TABLE 6

Impact of Chelating Agent on Enzyme Stability

| Composition | Chelant | Amine | Enzyme Activity @ 21 days | pH |
|---|---|---|---|---|
| 10 | 0.00 | 5.00 | 41.25 | 5.35 |
| 14 | 0.00 | 0.00 | 43.04 | 6.80 |
| 16 | 0.00 | 5.00 | 24.32 | 4.94 |
| 20 | 3.25 | 5.00 | 0.00 | 8.31 |
| 25 | 0.00 | 5.00 | 45.19 | 5.32 |

Example 6

Table 7 shows that compositions without solvent retain enzyme activity at 21 days. Compositions 13, 16, 19, 26 and 23 did not include a solvent and retained 15.71% to 56.10% enzyme activity at 21 days.

TABLE 7

Impact of Solvent on Enzyme Stability

| Composition | Solvent | Amine | Enzyme Activity @ 21 days | pH |
|---|---|---|---|---|
| 13 | 0.00 | 5.00 | 15.71 | 9.43 |
| 16 | 0.00 | 5.00 | 24.32 | 4.94 |
| 19 | 0.00 | 5.00 | 56.10 | 5.89 |
| 26 | 0.00 | 5.00 | 54.66 | 6.73 |
| 23 | 0.00 | 0.00 | 39.24 | 8.52 |

Example 7

Example 4 shows that nonionic surfactant and amine enhance enzyme stability. Example 7 shows that solvents do not improve enzyme stability. But, surprisingly, nonionic surfactants and solvents in specific ratios with the amine create a synergistic effect on enzyme stability. Compositions 10, 18, and 23-25 in table 8 show the improvement in enzyme stability as the ratio of [nonionic+solvent]:amine changes. A preferred ratio of [nonionic+solvent]:amine maintains at least 20% enzyme activity @ 21 days under 40° C. storage. A more preferred ratio maintains 20%-40% enzyme activity @ 21 days. And the most preferred ratio maintains >40% enzyme activity. Exemplary ratios of [nonionic+solvent]:amine that create these enzyme activity ranges include >25:1, <25:1, or >11:1.

TABLE 8

Impact of Ratio of [Nonionic + Solvent]:Amine on Enzyme Stability

| Composition | Nonionic Surfactant | Solvent | Amine | Enzyme Activity @ 21 days | Ratio [Nonionic + Solvent]:Amine | pH |
|---|---|---|---|---|---|---|
| 10 | 22.47 | 9.02 | 1.24 | 19.30 | 25.41 | 4.90 |
| 18 | 19.00 | 15.00 | 2.50 | 26.11 | 13.60 | 5.45 |
| 23 | 7.47 | 6.14 | 1.24 | 38.74 | 10.99 | 7.56 |
| 24 | 30.00 | 11.50 | 5.00 | 41.25 | 8.30 | 5.35 |
| 25 | 13.25 | 15.00 | 5.00 | 45.19 | 5.65 | 5.32 |

The foregoing summary, detailed description, and examples provide a sound basis for understanding the invention, and some specific example embodiments of the invention. Since the invention can comprise a variety of embodiments, the above information is not intended to be limiting. The invention resides in the claims.

The invention claimed is:

1. A concentrated antimicrobial enzymatic floor cleaning composition comprising:

a) a tertiary amine antimicrobial;

b) a lipase;

c) an organic acid;

d) a surfactant;

e) a glycol ether solvent;

f) an aminocarboxylate selected from the group consisting of methylglycinediacetic acid, glutamic-N,N-diacetic acid, and salts thereof; and g) about 50-80% water, wherein the total concentration of the surfactant, solvent and aminocarboxylate is from about 3.0 to about 50 wt. %, the ratio of the tertiary amine to the total concentration of the surfactant, solvent and aminocarboxylate is about (0.02-0.4):1, the composition has a pH range from about 4.9 to about 9.5, the composition has 15% of its original enzyme activity after 21 days at a temperature of 40° C., and the composition is free of boric acid or a boric acid salt.

2. The composition of claim 1, wherein ratio of organic acid:amine is between about 1:0.46 and about 1:2.85.

3. The composition of claim 1, wherein the organic acid is acetic acid.

4. A concentrated antimicrobial enzymatic floor cleaning composition comprising:

a) a tertiary amine antimicrobial;

b) an enzyme;

c) acetic acid;

d) a surfactant;

e) a glycol ether solvent;

f) an aminocarboxylate selected from the group consisting of methylglycinediacetic acid, glutamic-N,N-diacetic acid, and salts thereof; and g) about 50-80% water, wherein the total concentration of the surfactant, solvent and aminocarboxylate is from about 3.0 to about 50 wt. %, the ratio of the tertiary amine to the total concentration of the surfactant, solvent and aminocarboxylate is about (0.02-0.4):1, the composition has a pH range from about 4.9 to about 9.5, the composition has 15% of its original enzyme activity after 21 days at a temperature of 40° C., and the composition is free of boric acid or a boric acid salt.

5. The composition of claim 4, wherein ratio of acid:amine is between about 1:0.46 and about 1:2.85.

6. The composition of claim 4, wherein the aminocarboxylate is methylglycinediacetic acid.

7. The composition of claim 4, wherein the surfactant is a nonionic surfactant.

8. The composition according to claim 1 or 4, wherein the composition is configured for use in a hard surface detergent composition.

9. The composition according to claim 1 or 4, wherein the composition is configured for use in a floor cleaning composition.

10. The composition according to claim 1 or 4, wherein the composition is configured for use in a clean-in-place composition.

11. The composition according to claim 1 or 4, wherein the composition is configured for use in an endoscope reprocessing composition.

* * * * *

UNITED STATES PATENT AND TRADEMARK OFFICE

CERTIFICATE OF CORRECTION

PATENT NO. : 7,723,281 B1
APPLICATION NO. : 12/356435
DATED : May 25, 2010
INVENTOR(S) : Herdt et al.

It is certified that error appears in the above-identified patent and that said Letters Patent is hereby corrected as shown below:

Col. 18, line 53, claim 8: "claim 1 or 4, wherein" should read --claims 1 or 4, wherein--

Col. 18, line 57, claim 9: "claim 1 or 4, wherein" should read --claims 1 or 4, wherein--

Col. 18, line 60, claim 10: "claim 1 or 4, wherein" should read --claims 1 or 4, wherein--

Col. 18, line 63, claim 11: "claim 1 or 4, wherein" should read --claims 1 or 4, wherein--

Signed and Sealed this

Fourteenth Day of September, 2010

David J. Kappos

David J. Kappos
*Director of the United States Patent and Trademark Office*